US007059255B2

(12) United States Patent
Tsai

(10) Patent No.: US 7,059,255 B2
(45) Date of Patent: Jun. 13, 2006

(54) PLASTIC TABLETOP WITH LONGITUDINAL MID-SUPPORT ARRANGEMENT FOR FOLDABLE TABLE

(75) Inventor: Frank Tsai, Taipei (TW)

(73) Assignee: Wok & Pan Ind., Inc., Guangdong (CN)

( * ) Notice: Subject to any disclaimer, the term of this patent is extended or adjusted under 35 U.S.C. 154(b) by 375 days.

(21) Appl. No.: 10/704,311

(22) Filed: Nov. 10, 2003

(65) Prior Publication Data

US 2005/0098070 A1 May 12, 2005

(51) Int. Cl.
*A47B 3/00* (2006.01)

(52) U.S. Cl. ..... 108/129; 108/161

(58) Field of Classification Search ..... 108/132, 108/131, 129, 161, 130, 57.25, 115, 901, 108/902; 248/188.6, 939
See application file for complete search history.

(56) References Cited

U.S. PATENT DOCUMENTS 2,474,450 A * 6/1949 Woodruff ..... 108/132
3,416,468 A * 12/1968 Peterson et al. ..... 108/131
5,271,338 A * 12/1993 Bonham ..... 108/161
5,678,491 A * 10/1997 Price et al. ..... 108/115
5,732,637 A * 3/1998 Raab ..... 108/129
5,868,080 A * 2/1999 Wyler et al. ..... 108/57.25
5,947,037 A * 9/1999 Hornberger et al. ..... 108/115
6,058,853 A * 5/2000 Pinch ..... 108/129
6,371,034 B1 * 4/2002 Simpson et al. ..... 108/129
6,823,806 B1 * 11/2004 Buono ..... 108/132
6,968,789 B1 * 11/2005 Baik et al. ..... 108/132

* cited by examiner

*Primary Examiner*—Jose V. Chen
(74) *Attorney, Agent, or Firm*—Raymond Y. Chan; David and Raymond Patent Firm

(57) ABSTRACT

A tabletop includes a tabletop member and longitudinal mid-support arrangement. The tabletop member includes a plastic made top panel and a plastic made bottom panel which is overlapped connected with the top panel in an edge to edge manner and defines a receiving cavity between the top and bottom panels. The longitudinal mid-support arrangement includes a mid-runner longitudinally received in the receiving cavity of the tabletop member at a mid-portion thereof to strengthen the tabletop member, wherein the mid-runner has two end portions for pivotally connecting two leg frames respectively, and two root portions for pivotally connecting two retaining frames respectively, such that the longitudinal mid-support arrangement is adapted for evenly distributing and supporting a downward loading force on the tabletop member to the leg frames through the mid-runner.

20 Claims, 4 Drawing Sheets

PLASTIC TABLETOP WITH LONGITUDINAL MID-SUPPORT ARRANGEMENT FOR FOLDABLE TABLE

BACKGROUND OF THE PRESENT INVENTION

1. Field of Invention

The present invention relates to a banquet table, and more particularly to a plastic tabletop with a longitudinal mid-support arrangement for a foldable table, wherein the longitudinal mid-support arrangement is supported within the plastic tabletop at a mid-portion thereof for substantially enhancing the strength of the tabletop and the leg assembly in a foldably movable manner.

2. Description of Related Arts

Banquet tables have become very popular since the tables are economy, cheap and foldable that can be quickly and easily folded for carriage and storage and unfolded for use. Especially when some participant-intensive activities take place in multi-function rooms or designated areas, the banquet tables can be temporary set up in minutes. After the functions, the banquet tables can be quickly and neatly folded up for storage.

A conventional banquet table comprises a tabletop and a pair of table legs foldable mounted underneath the tabletop. For example, U.S. Pat. No. 5,957,061 generally suggests a banquet table that two table legs are pivotally mounted at two opposed side end portions of the tabletop. Since the two table legs support the tabletop at two side end portions thereof, when a downward loading force is applied on the tabletop, a mid-portion of the tabletop may be cracked easily. In order to enhance the rigid structure of the banquet table, the tabletop must be made of stiffness material such as wood or metal. However, the wooden or metal tabletop will increase the overall weight of the banquet table that reduces the portability of the banquet table.

In order to enhance the portability of the banquet table, the tabletop is made of lightweight material such as plastic. One of the common technologies to manufacture the tabletop is known as the plastic "air-blow" molding technique. Therefore, the overall weight of the banquet table will be substantially reduced by the plastic tabletop. However, such banquet table having the plastic tabletop has several drawbacks.

The strength of such plastic tabletop is weak that the mid-portion of the plastic tabletop may be cracked easily due to the downward loading force. Accordingly, U.S. Pat. No. 6,431,092 generally suggests a banquet table generally comprises a plastic made top panel, two metal made side runners longitudinally mounted under the top panel, and a metal made reinforcing arm transversely mounted below a mid-portion of the top panel 1 between the two side runners to substantially increase the strength of the top panel.

In addition, in order to foldably attach the table leg to the tabletop, the table leg comprises a standing leg rotatably mounted between the side runners and a folding leg pivotally mounted between the standing leg and the reinforcing arm such that the standing leg is capable of pivotally folding under the top panel of the tabletop. As a result, the reinforcing arm not only enhances the strength of the top panel but also rigidly supports the table leg in a foldable manner. In other words, the plastic tabletop must include the reinforcing arm in order to form the banquet table.

However, the reinforcing arm restricts the pivotally attaching position of the folding leg. Since the reinforcing arm is transversely mounted at the middle of the tabletop, the folding leg must be long enough to pivotally extend from the standing leg to the reinforcing arm, which may weaken the strength of the folding leg.

SUMMARY OF THE PRESENT INVENTION

A main object of the present invention is to provide a plastic tabletop with a longitudinal mid-support arrangement for a foldable table, wherein the longitudinal mid-support arrangement comprises a mid-runner supported within the plastic tabletop at a mid-portion thereof for substantially enhancing the strength of the tabletop and the leg assembly in a foldably movable manner.

Another object of the present invention is to provide a plastic tabletop with a longitudinal mid-support arrangement, wherein the plastic tabletop has a top panel overlapped with a bottom panel to form a receiving cavity to longitudinally receive the mid-runner between the top and bottom panels. Therefore, the overall weight of the plastic tabletop can be substantially minimized without reducing the strength thereof.

Another object of the present invention is to provide a plastic tabletop with a longitudinal mid-support arrangement which has a rigid, simple, and strong structure to evenly distribute and support a downward loading force on the plastic tabletop to the leg assembly through the mid-runner.

Another object of the present invention is to provide a plastic tabletop with a longitudinal mid-support arrangement, wherein the plastic tabletop further comprises a plurality of reinforcing ribs longitudinally extended between the top and bottom panels within the receiving cavity. Therefore, the reinforcing ribs not only retain the mid-runner in position with respect to the plastic tabletop but also enhance the strength of the plastic tabletop.

Another object of the present invention is to provide a plastic tabletop with a longitudinal mid-support arrangement, wherein the manufacturing process is simplified by forming the one-piece integral plastic tabletop via a plastic 'air blow' extrusion molding technique and sliding the mid-runner into one of the holding slots of the reinforcing ribs within the receiving cavity of the plastic tabletop.

Another object of the present invention is to provide a plastic tabletop with a longitudinal mid-support arrangement, wherein a folding frame of the leg assembly is adapted to adjustably couple along the mid-runner to retain the leg assembly in a folded position. In other words, a length of the folding frame can be substantially shortened to couple between the standing leg and the mid-runner so as to enhance the strength of the leg assembly.

Another object of the present invention is to provide a plastic tabletop with a longitudinal mid-support arrangement, wherein the mid-runner provides a substantial support without altering or complicating the original structure of the foldable table, so as to minimize the manufacturing cost of the plastic tabletop incorporating with any conventional leg assembly.

Another object of the present invention is to provide a plastic tabletop with a longitudinal mid-support arrangement, wherein no expensive or mechanical structure is required to employ in the present invention in order to achieve the above mentioned objects. Therefore, the present invention successfully provides an economic and efficient solution not only for providing a reinforced supporting configuration to the tabletop but also for enhancing the folding movement of the leg assembly with respect to the tabletop.

Accordingly, in order to accomplish the above mentioned objects, the present invention provides a tabletop for a foldable table having two retaining frames foldably supporting two leg frames respectively thereto, wherein the tabletop comprises:

a tabletop member comprising a plastic made top panel and a plastic made bottom panel which is overlapped connected with the top panel in an edge to edge manner and defines a receiving cavity between the top and bottom panels; and a longitudinal mid-support arrangement comprising a mid-runner longitudinally received in the receiving cavity of the tabletop member at a mid-portion thereof to strengthen the tabletop member, wherein the mid-runner has two end portions for pivotally connecting the two leg frames respectively, and two root portions for pivotally connecting the two retaining frames respectively, such that the longitudinal mid-support arrangement is adapted for evenly distributing and supporting a downward loading force on the tabletop member to the leg frames through the mid-runner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
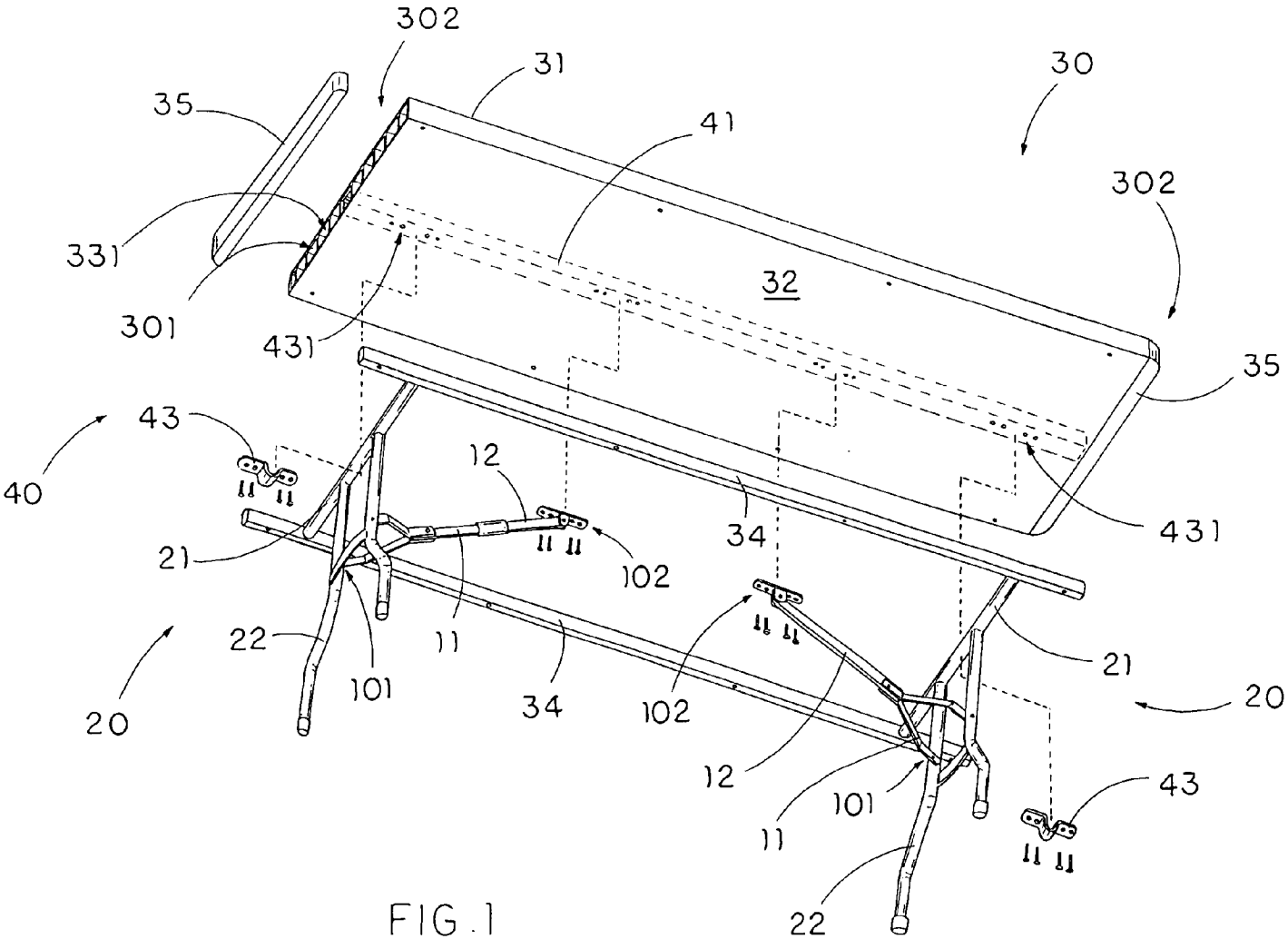
FIG. 1 is an exploded perspective view of a plastic tabletop with a longitudinal mid-support arrangement for a foldable table according to a preferred embodiment of the present invention.

Referring to FIG. 1 of the drawings, a tabletop according to a preferred embodiment of the present invention is illustrated, wherein the tabletop, which is adapted for incorporating with a foldable table comprising two retaining frames 10 foldably supporting two leg frames 20 respectively thereto, comprises a tabletop member 30 and a longitudinal mid-support arrangement 40.

The tabletop member 30 comprises a plastic made top panel 31 and a plastic made bottom panel 32 which is overlapped connected with the top panel 31 in an edge to edge manner and defines a receiving cavity 301 between the top and bottom panel 31, 32.

Figure 3:
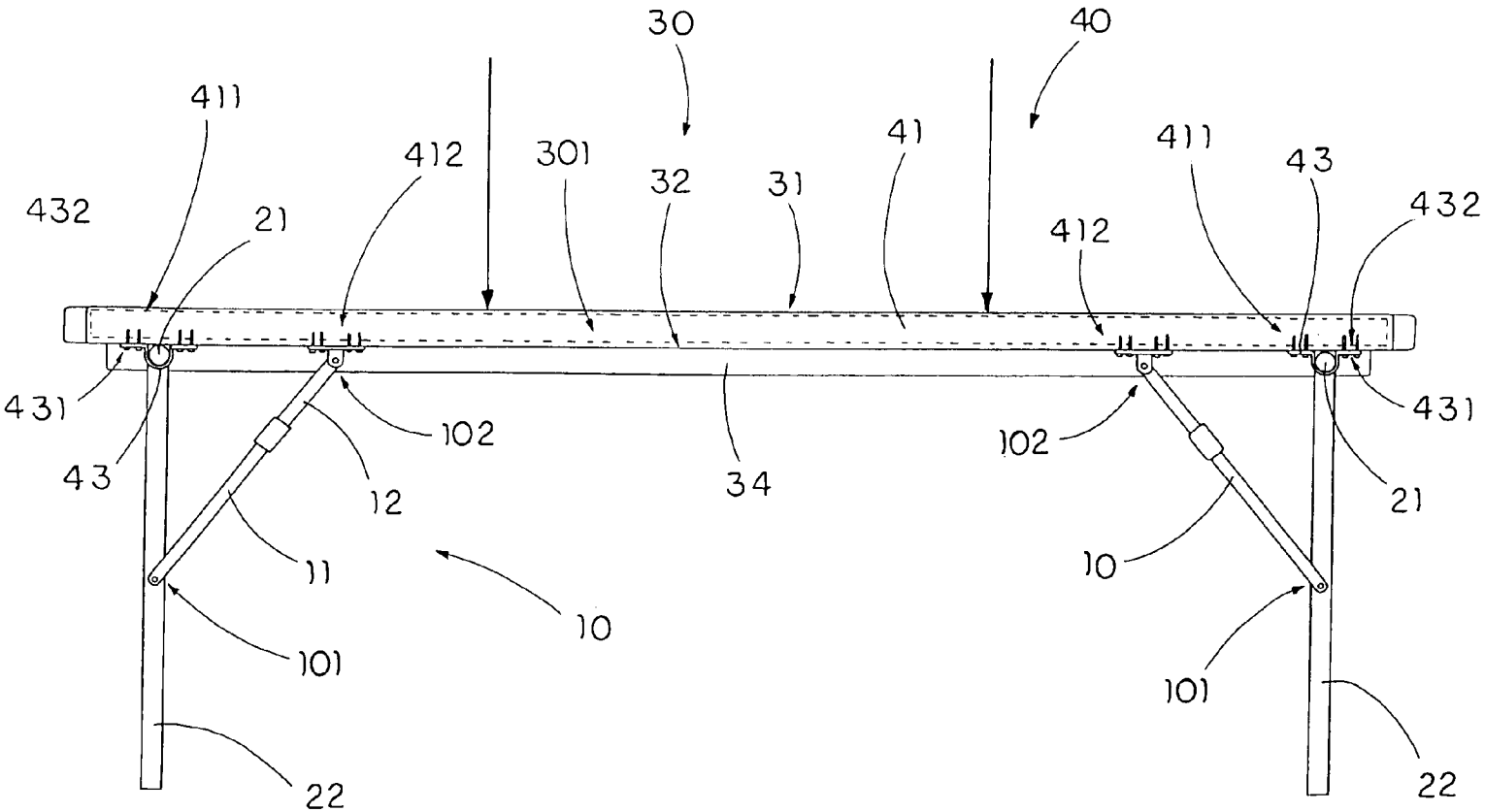
FIG. 3 is a side sectional view of the plastic tabletop with the longitudinal mid-support arrangement according to the above preferred embodiment of the present invention.

The longitudinal mid-support arrangement 40 comprises a mid-runner 41 longitudinally received in the receiving cavity 301 of the tabletop member 30 at a mid-portion thereof to strengthen the tabletop member 30, wherein the mid-runner has two end portions 411 for pivotally connecting the two leg frames 20 respectively, and two root portions 412 for pivotally connecting the two retaining frames 10 respectively, such that the longitudinal mid-support arrangement 40 is adapted for evenly distributing and supporting a downward loading force on the tabletop member 30 to the leg frames 20 through the mid-runner 41, as shown in FIG. 3.

According to the preferred embodiment, the tabletop member 30 is made of light weight but rigid material such as plastic by plastic 'air blow' extrusion molding or FRP such that the top panel 31 is integrally connected to the bottom panel 31 in an edge to edge manner. It is worth to mention that the process of the manufacturing the tabletop member 30 is simplified through the plastic 'air blow' extrusion molding technique so as to minimize the manufacturing cost of the tabletop of the present invention.

Figure 2:
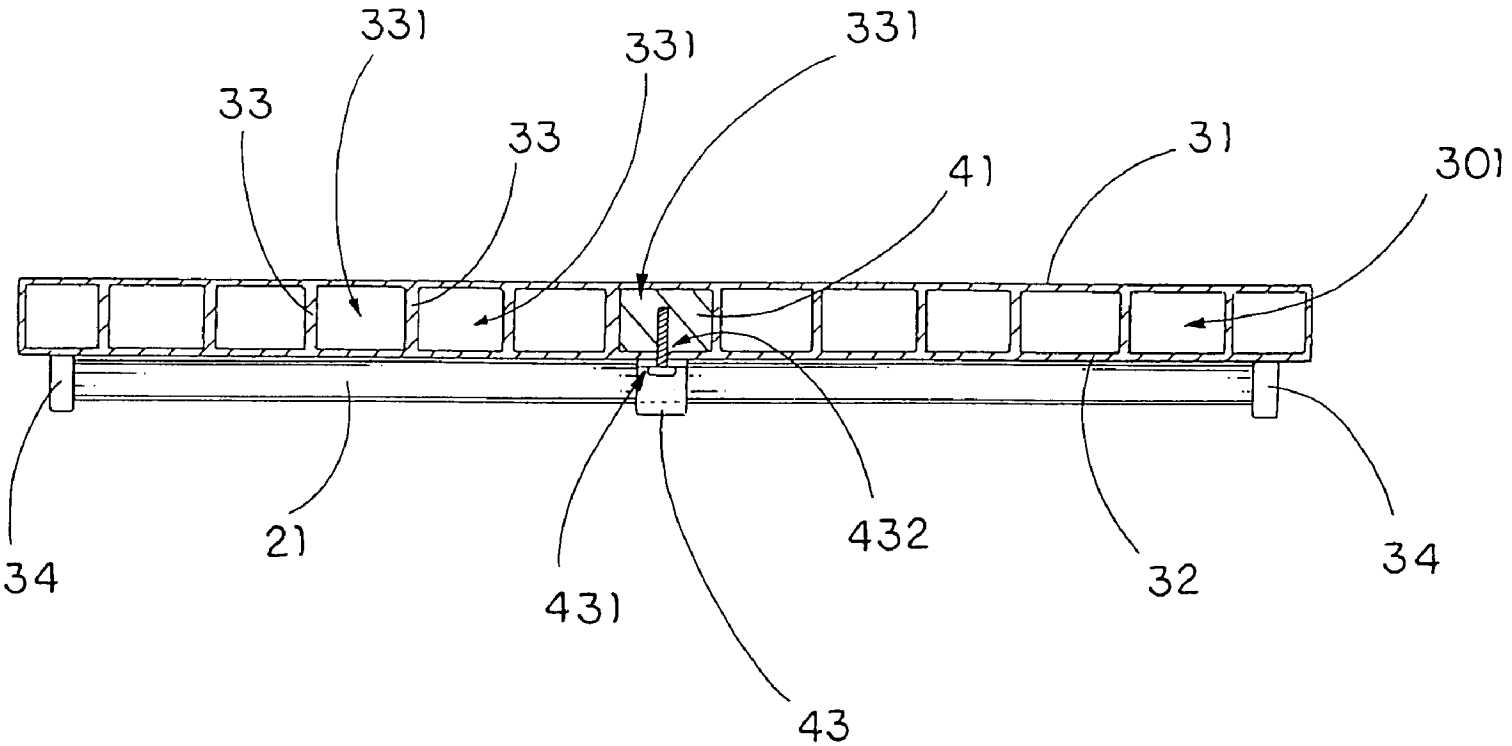
FIG. 2 is a front sectional view of the foldable table incorporated with the plastic tabletop having the longitudinal mid-support arrangement according to the above preferred embodiment of the present invention.

As shown in FIG. 2, the tabletop member 30 further has two transverse openings 302 provided at transverse edges of the top and bottom panels 31, 32 of the tabletop member 30 to communicate with the receiving cavity 301, and two edge protectors 35 sealedly mounted to the two transverse openings 302 of the tabletop member 30 to enclose the receiving cavity 301.

The mid-runner 41, which is made of rigid material such as metal, is longitudinally received in the receiving cavity 301 of the tabletop member 30 at a mid-portion thereof wherein the mid-runner 41 has a predetermined length shorter than a length of the tabletop member 30 in such a manner that when the mid-runner 41 is supported between the top and bottom panels 31, 32, the two end portions 411 of the mid-runner 41 are extended towards the two transverse openings 302 of the tabletop member 30.

As shown in FIGS. 1 and 2, each of the leg frames 20 has an upper portion transversely and rotatably connected to the respective end portion 411 of the mid-runner 41 such that the leg frames 20 are adapted for folding between a folded position and an unfolded position. Accordingly, at the folded position, the leg frames 20 are pivotally and inwardly folded to rest on the bottom panel 32 of the tabletop member 30, and at the unfolded position, the leg frames 20 are pivotally and outwardly folded to perpendicularly stand under the tabletop member 30.

Each of the leg frames 20 comprises a transverse member 21 rotatably and transversely connected to the respective end portion 411 of the mid-runner 41 and a standing leg 22 downwardly extended from the transverse member 21 in such a manner that each of the standing legs 22 is adapted to pivotally fold between the folded position and the unfolded position.

Each of the retaining frames 10 has a first coupling end 101 pivotally coupling with the respective leg frame 20 and a second coupling end 102 pivotally coupling with the respective root portion 412 of the mid-runner 41 such that when the leg frames 20 are outwardly and pivotally folded, each of the retaining frames 10 limits a pivot movement of the respective leg frame 20 with respect to the mid-runner 41 so as to retain the respective leg frame 20 at the unfolded position.

Accordingly, each of the retaining frames 10 comprises a retaining brace 11 defining the first coupling end 101 to pivotally connect to the standing leg 12 of the respective leg frame 20 and a retaining arm 12 which is pivotally connected to the retaining brace 11 and defines the second coupling end 102 to pivotally connect to the respective root portion 412 of the mid-runner 41 through the bottom panel 32 via a screw such that when the leg frames 20 are inwardly and pivotally folded to the folded position, the retaining braces 11 are pivotally folded to overlap with the retaining arms 12 respectively. In other words, the retaining brace 11 is pivotally folded with respect to the retaining arm 12 to extend a distance between the first coupling end 101 of the retaining frame 10 and the second coupling end 102 thereof so as to retain the respective leg frame 20 at the unfolded position.

It is worth to mention that the second coupling end 102 of the respective retaining frame 10 can be adjustably coupled along the root portion 412 of the mid-runner 41 at any position between the two end portions 411 thereof depending on the length of the tabletop member 30 such that the tabletop member 30 can rigidly support a greater downward loading force thereon in comparison with the conventional foldable table since the mid-runner 41 of the longitudinal mid-support arrangement 40 not only substantially supports the tabletop member 30 but also evenly distributes the downward loading force to the leg frames 20. In other words, each of the retaining frames 10 does not need to pivotally extend the second coupling end 102 thereof from the respective leg frame 20 to a mid-portion of the tabletop member 30 so as to substantially enhance the rigid configuration of the retaining frame 10.

In addition, when the leg frames 20 and the retaining frames 10 are respectively connected to the end portions 411 and the root portions 412 of the mid-runner 41, the mid-runner 41 is securely locked up within the receiving cavity 301 so as to prevent an unwanted movement of the mid-runner 41 with respect to the tabletop member 30.

As shown in FIGS. 1 and 2, the tabletop member 30 further comprises a plurality of reinforcing ribs 33 longitudinally and spacedly extended within the receiving cavity 301 to form a longitudinal holding slot 331 between each two reinforcing ribs 33, wherein each of the reinforcing ribs 33 is integrally extended between the top and bottom panels 31, 32 to enhance the strength of the tabletop member 30.

The mid-runner 41 is slidably received in one of the holding slot 331 of the tabletop member 30 to retain the mid-runner 41 at the mid-portion of the tabletop member 30. Therefore, the reinforcing ribs 33 not only retain the mid-runner 41 in position within the respective holding slot 331 at the mid-portion of the tabletop member 30 but also enhance the strength of the tabletop member 30 for supporting greater loading force thereon.

The longitudinal mid-support arrangement 40 further comprises two frame connectors 43 for rotatably mounting the leg frames 20 to the end portions 411 of the mid-runner 41 respectively, wherein each of the frame connectors 43 has two ends securely connected the respective end portion 411 of the mid-runner 41 on the bottom panel 32 for rotatably mounting the respective leg frame 20 under the bottom panel 32, so as to lock up the mid-runner 41 within the receiving cavity 301.

As shown in FIG. 1, each of the frame connectors 43, having a C-shaped, has two ends extended for rotatably coupling with the transverse member 21 of the leg frames 20 to securely connect with the respective end portion 411 of the mid-runner 41 through the bottom panel 32. As shown in FIG. 3, two pairs of attachment holes 431 are formed at two transverse sides of the bottom panel 32 aligned with the mid-runner 41 and two pairs of mounting holes 432 are respectively provided along the two end portions 411 of the mid-runner 41 to align with the four attachment holes 431 such that the two ends of each of the frame connectors 43 are securely attached the mid-runner 41 on the bottom panel 32 via two screws engaging with the mounting holes 432 through the attachment holes 431 respectively.

In order to further enhance the strength of the tabletop member 30, the tabletop member 30 further comprises two side runners 34 longitudinally extended along two longitudinal side edges of the tabletop member 30 wherein the upper portion of the leg frames 20 are rotatably connected between the two side runners 34.

As shown in FIG. 2, the two side runners 34 are positioned underneath the bottom panel 32 wherein two ends of each of the transverse members 21 are rotatably engaged with the two side runners 34, so as to reinforce the pivotal movement of each of the leg frames 20.

Figure 4:
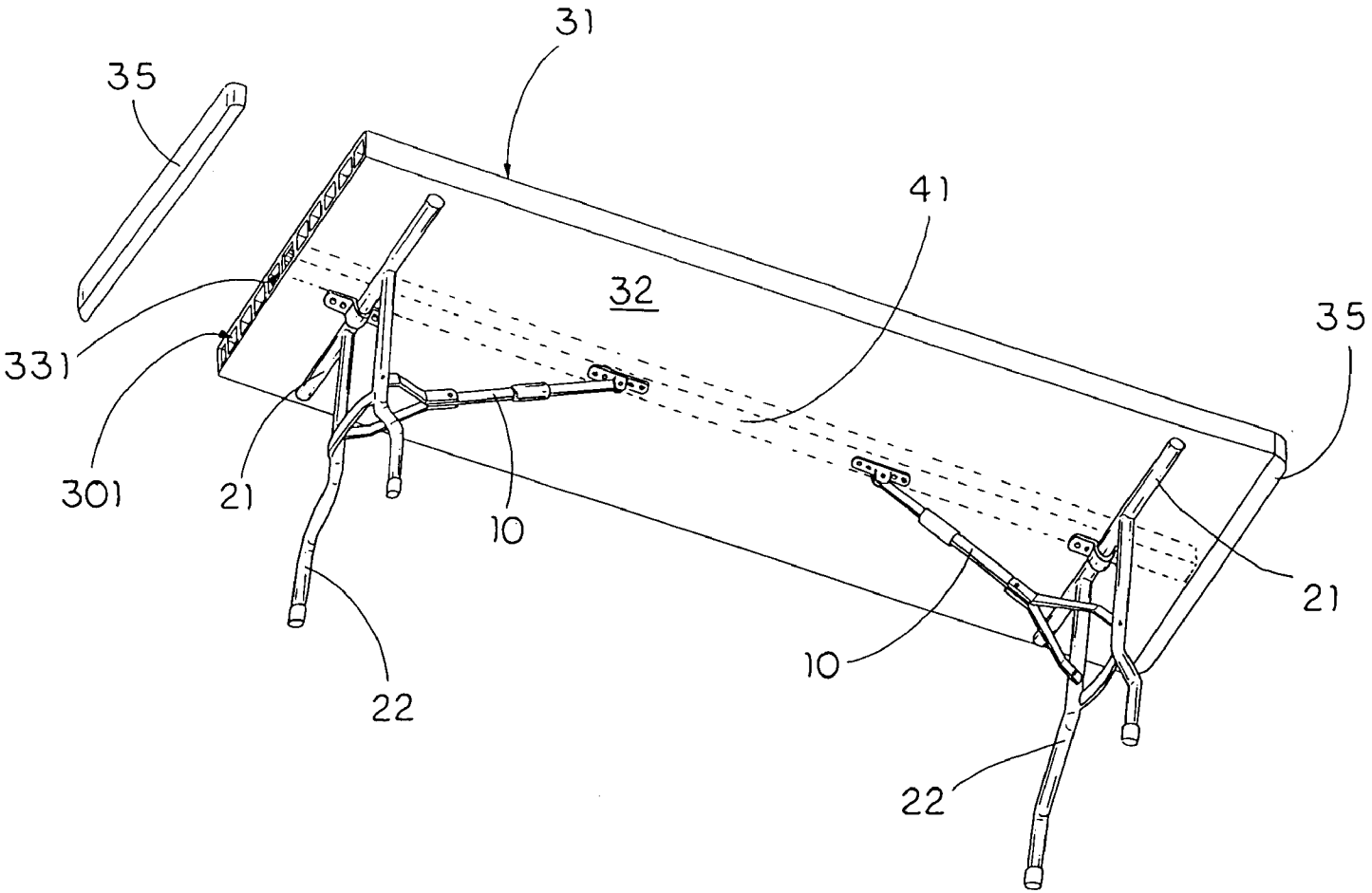
FIG. 4 illustrates an alternative mode of the plastic tabletop with the longitudinal mid-support arrangement according to the above preferred embodiment of the present invention.

It is worth to mention that the two side runners 34 are optionally connected underneath the tabletop member 30 since the mid-runner 41 is rigid enough to strengthen the tabletop member 30 to distribute and support a downward loading force on the tabletop member 30 to the leg frames 20. Therefore, even though there is no side runner mounted to the tabletop member 30, the tabletop of the present invention is strong enough to support the downward loading force applied thereon, as shown in FIG. 4.

However, in order to further strengthen the tabletop member 30, the two side runners 34 can be slid into two holding slots 331 at two longitudinal edge portions of the tabletop member 30 such that the two side runners 34 are received in the receiving cavity 301 in a hidden manner so as to become parts of the tabletop member 30.

According to the preferred embodiment, the process of manufacturing the tabletop is simplified, since the tabletop member 30 is made by plastic air blow extrusion molding, especially for mass production, the top panel 31, the bottom panel 32, and the reinforcing ribs 33 are formed in a one piece integral member. Then, the mid-runner 41 is slid into the receiving cavity 301 along the corresponding holding slot 331 to retain the mid-runner 41 at the mid-portion of the tabletop member 30 while the edge protectors 35 are sealed at the two transverse openings 302 of the tabletop member 30 to enclose the receiving cavity 301 thereof. Therefore, by attaching the leg frames 20 and the retaining frames 10 to the end portions 411 and the root portions 412 of the mid-runner 41 respectively, the mid-runner 41 is securely locked up within the receiving cavity 301 of the tabletop member 30.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A tabletop for a foldable table having two retaining frames foldably supporting two leg frames respectively thereto, wherein said tabletop comprises:

a tabletop member comprising a plastic made top panel and a plastic made bottom panel which is overlapped connected with said top panel in an edge to edge manner and defines a receiving cavity between said top and bottom panels; and a longitudinal mid-support arrangement comprising a mid-runner longitudinally received in said receiving cavity of said tabletop member at a mid-portion thereof to strengthen said tabletop member, wherein said mid-runner has two end portions for pivotally connecting said two leg frames respectively through said bottom panel, and two root portions for pivotally connecting said two retaining frames respectively through said bottom panel, such that said longitudinal mid-support arrangement is adapted for evenly distributing and supporting a downward loading force on said tabletop member to said leg frames through said mid-runner.

2. The tabletop, as recited in claim 1, wherein said tabletop member further comprises a plurality of reinforcing ribs longitudinally and spacedly extended within said receiving cavity, wherein each of said reinforcing ribs is integrally extended between said top and bottom panel to strengthen said tabletop member.

3. The tabletop, as recited in claim 2, wherein said longitudinal mid-support arrangement further comprises two frame connectors for rotatably mounting said leg frames to said end portions of said mid-runner respectively through said bottom panel, wherein each of said frame connectors is securely connected said respective end portion of said mid-runner on said bottom panel for rotatably mounting said respective leg frame under said bottom panel, so as to lock up said mid-runner within said receiving cavity.

4. The tabletop, as recited in claim 2, wherein a longitudinal holding slot is formed between each two said reinforcing ribs, wherein said mid-runner is slidably received in one of said holding slots so as to retain said mid-runner at said mid-portion of said tabletop member in position.

5. The tabletop, as recited in claim 4, wherein said longitudinal mid-support arrangement further comprises two frame connectors for rotatably mounting said leg frames to said end portions of said mid-runner respectively through said bottom panel, wherein each of said frame connectors is securely connected said respective end portion of said mid-runner on said bottom panel for rotatably mounting said respective leg frame under said bottom panel, so as to lock up said mid-runner within said receiving cavity.

6. The tabletop, as recited in claim 5, wherein said tabletop member is made by plastic air blow extrusion molding to integrally connect said top panel to said bottom panel in an edge to edge manner.

7. The tabletop, as recited in claim 6, wherein said tabletop member has two transverse openings respectively formed at two transverse sides of said tabletop member to communicate with said receiving cavity, and two edge protectors sealedly mounted to said two transverse openings of said tabletop member to enclose said receiving cavity.

8. The tabletop, as recited in claim 4, wherein said tabletop member is made by plastic air blow extrusion molding to integrally connect said top panel to said bottom panel in an edge to edge manner.

9. The tabletop, as recited in claim 8, wherein said tabletop member has two transverse openings respectively formed at two transverse sides of said tabletop member to communicate with said receiving cavity, and two edge protectors sealedly mounted to said two transverse openings of said tabletop member to enclose said receiving cavity.

10. The tabletop, as recited in claim 1, wherein said longitudinal mid-support arrangement further comprises two frame connectors for rotatably mounting said leg frames to said end portions of said mid-runner respectively through said bottom panel, wherein each of said frame connectors is securely connected said respective end portion of said mid-runner on said bottom panel for rotatably mounting said respective leg frame under said bottom panel, so as to lock up said mid-runner within said receiving cavity.

11. The tabletop, as recited in claim 1, wherein said tabletop member is made by plastic air blow extrusion molding to integrally connect said top panel to said bottom panel in an edge to edge manner.

12. The tabletop, as recited in claim 11, wherein said tabletop member has two transverse openings respectively formed at two transverse sides of said tabletop member to communicate with said receiving cavity, and two edge protectors sealedly mounted to said two transverse openings of said tabletop member to enclose said receiving cavity.

13. A foldable table, comprising:

a tabletop, comprising:

a tabletop member comprising a plastic made top panel and a plastic made bottom panel which is overlapped connected with said top panel in an edge to edge manner and defines a receiving cavity between said top and bottom panels; and a longitudinal mid-support arrangement comprising a mid-runner longitudinally received in said receiving cavity of said tabletop member at a mid-portion thereof to strengthen said tabletop member, wherein said mid-runner has two end portions and two root portions defined between said two end portions;

two leg frames which are pivotally connected to said end portions of said mid-runner respectively under said bottom panel and are arranged to fold between a folded position and an unfolded position, wherein at said folded position, said leg frames are pivotally and inwardly folded to rest on said bottom panel of said tabletop member, and at said unfolded position, said leg frames are pivotally and outwardly folded to perpendicularly stand under said tabletop member; and two retaining frames, each having a first coupling end pivotally coupling with said respective leg frame and a second coupling end pivotally coupling with said respective root portion of said mid-runner through said bottom panel to retain said respective leg frame at said unfolded position.

14. The foldable table, as recited in claim 13, wherein said tabletop member further comprises a plurality of reinforcing ribs longitudinally and spacedly extended within said receiving cavity, wherein each of said reinforcing ribs is integrally extended between said top and bottom panel to strengthen said tabletop member.

15. The foldable table, as recited in claim 14, wherein a longitudinal holding slot is formed between each two said reinforcing ribs, wherein said mid-runner is slidably received in one of said holding slots so as to retain said mid-runner at said mid-portion of said tabletop member in position.

16. The foldable table, as recited in claim 15, wherein said longitudinal mid-support arrangement further comprises two frame connectors rotatably mounting said leg frames to said end portions of said mid-runner respectively through said bottom panel, so as to lock up said mid-runner within said receiving cavity.

17. The foldable table, as recited in claim 16, wherein said tabletop member, which is made by plastic air blow extrusion molding to integrally connect said top panel to said bottom panel in an edge to edge manner, has two transverse openings respectively formed at two transverse sides of said tabletop member to communicate with said receiving cavity, and two edge protectors sealedly mounted to said two transverse openings of said tabletop member to enclose said receiving cavity.

18. The foldable table, as recited in claim 15, wherein said tabletop member, which is made by plastic air blow extrusion molding to integrally connect said top panel to said bottom panel in an edge to edge manner, has two transverse openings respectively formed at two transverse sides of said tabletop member to communicate with said receiving cavity, and two edge protectors sealedly mounted to said two transverse openings of said tabletop member to enclose said receiving cavity.

19. The foldable table, as recited in claim 13, wherein said longitudinal mid-support arrangement further comprises two frame connectors rotatably mounting said leg frames to said end portions of said mid-runner respectively through said bottom panel, so as to lock up said mid-runner within said receiving cavity.

20. The foldable table, as recited in claim 13, wherein said tabletop member, which is made by plastic air blow extrusion molding to integrally connect said top panel to said bottom panel in an edge to edge manner, has two transverse openings respectively formed at two transverse sides of said tabletop member to communicate with said receiving cavity, and two edge protectors sealedly mounted to said two transverse openings of said tabletop member to enclose said receiving cavity.

* * * * *